US009078291B2

(12) United States Patent
Planelid

(10) Patent No.: US 9,078,291 B2
(45) Date of Patent: Jul. 7, 2015

(54) DEVICE FOR HEATING A VEHICLE SEAT

(75) Inventor: Lars Planelid, Almestad (SE)

(73) Assignee: KONGSBERG AUTOMOTIVE AB, Mullsjö (SE)

( * ) Notice: Subject to any disclaimer, the term of this patent is extended or adjusted under 35 U.S.C. 154(b) by 112 days.

(21) Appl. No.: 13/359,295

(22) Filed: Jan. 26, 2012

(65) Prior Publication Data

US 2013/0193128 A1 Aug. 1, 2013

(51) Int. Cl.
*H05B 1/02* (2006.01)

(52) U.S. Cl.
CPC ..... *H05B 1/0238* (2013.01)

(58) Field of Classification Search
CPC ..... H05B 1/0238; A47C 7/72; A47C 31/00; B60L 1/00; B60L 1/02
USPC ..... 219/201, 202, 217, 494, 497; 297/180.1–180.16; 307/9.1, 10.1
See application file for complete search history.

(56) References Cited

U.S. PATENT DOCUMENTS

| | | | | |
|---|---|---|---|---|
| 4,700,046 | A | 10/1987 | Fristedt | |
| 4,885,456 | A * | 12/1989 | Tanaka et al. | 219/497 |
| 5,075,537 | A * | 12/1991 | Lorenzen et al. | 219/497 |
| 5,229,579 | A | 7/1993 | Ingraham et al. | |
| 5,288,974 | A * | 2/1994 | Hanzic | 219/501 |
| 5,894,394 | A | 4/1999 | Baba et al. | |
| 6,124,577 | A * | 9/2000 | Fristedt | 219/497 |
| 6,278,090 | B1 * | 8/2001 | Fristedt et al. | 219/497 |
| 6,369,468 | B1 | 4/2002 | Goings et al. | |
| 6,552,442 | B2 * | 4/2003 | Liao et al. | 307/9.1 |
| 6,594,161 | B2 * | 7/2003 | Jansen et al. | 363/21.14 |
| 6,664,518 | B2 * | 12/2003 | Fristedt | 219/497 |
| 6,689,989 | B2 * | 2/2004 | Irwin et al. | 219/212 |
| 6,728,602 | B2 * | 4/2004 | Husted et al. | 700/299 |
| 6,756,697 | B2 * | 6/2004 | Mizutani et al. | 307/10.1 |

(Continued)

FOREIGN PATENT DOCUMENTS

| | | | |
|---|---|---|---|
| DE | 3732841 | A1 | 4/1989 |
| JP | 2009066009 | A | 1/2012 |

OTHER PUBLICATIONS

Field-effect transistor—Wikipedia, the free encyclopedia, http://web.archive.org/web/20111017055317/http://en.wikipedia.org/wiki/Field-effect_transistor, Oct. 17, 2011.*

(Continued)

*Primary Examiner* — Dana Ross
*Assistant Examiner* — John J Norton
(74) *Attorney, Agent, or Firm* — Howard & Howard Attorneys PLLC

(57) ABSTRACT

A vehicle seat having a first temperature control unit and a second temperature control unit. Each control unit has power-input terminals for receiving power from a vehicle electrical power system and power-output terminals. The first control unit has a logic part for comparing received temperature selection and temperature measurement values along with a first pulse generator connected to a first output terminal of the logic part and a second pulse generator connected to a second output terminal of the logic part as well as a first switch unit coupled to the first pulse generator. The second temperature control unit includes a second switch unit coupled to the second pulse generator. First and second heating elements are coupled to the temperate control units. An occupant switch is coupled to the first temperate control unit. A first temperature sensor monitors the thermal output of the first heating element.

16 Claims, 4 Drawing Sheets

(56) References Cited

U.S. PATENT DOCUMENTS

| | | | |
|---|---|---|---|
| 6,914,217 | B2 | 7/2005 | Fristedt |
| 7,274,007 | B2 | 9/2007 | Fernandez et al. |

OTHER PUBLICATIONS

Voltage doubler—Wikipedia, the free encyclopedia, http://web.archive.org/web/20100919025913/http://en.wikipedia.org/wiki/Voltage_doubler, Sep. 19, 2010.*

Multiplexing—Wikipedia, the free encyclopedia, http://web.archive.org/web/20111005020822/http://en.wikipedia.org/wiki/Multiplexing, Oct. 5, 2011.*

English Language Abstract for DE 3732841 extracted from Espacenet.com database on Apr. 10, 2014, 1 page.

English Language Translation for DE 3732841 extracted from Espacenet.com database on Apr. 10, 2014, 6 pages.

English Language Abstract for JP 2009066009 extracted from PAJ database on Apr. 10, 2014, 1 page.

English Language Translation for JP 2009066009 extracted from PAJ database on Apr. 10, 2014, 7 pages.

* cited by examiner

DEVICE FOR HEATING A VEHICLE SEAT

FIELD OF THE INVENTION

The present invention relates to relating to devices for controlling heat generating loads, as well as devices having control units in a master-slave configuration, and more particularly to such devices used for heating a vehicle seat.

BACKGROUND OF THE INVENTION

It is well known to heat vehicle seats with a heating element comprising an electrically resistive conductor that generates heat upon an electric current being passed through it. Moreover, it is known to individually provide both the seat bottom portion and the seat backrest portion with such heating elements.

Early versions of such seat heating devices electrically connected the seat bottom portion and backrest portion heating elements in series, with both heaters controlled jointly by a single controller. Such devices suffered from occupants experiencing unpleasant physiological impressions of unequal heating between the seat bottom portion and backrest portion, despite occupant efforts to adjustably control the temperature setting via the device's control interface. Moreover, such devices tended to undesirably tax the vehicle's electrical system and required wiring harnesses having conductors of large size to accommodate the necessary current to power the series-connected heaters. Lower-powered, more comfortable, and less expensive alternatives were desired.

More recently, vehicle seat heating devices have typically electrically connected the seat bottom portion and backrest portion heating elements in parallel, each with a respective controller. The controllers may be individually adjusted by the occupant to control the amount of physiologically-sensed heating provided to the seat bottom portion and backrest portion. For example, German Patent Publication No. DE 3732841 (the '841 Publication) discloses a device for heating a vehicle seat that includes parallel-connected first and second control units that are coupled to the seat bottom portion and backrest portion heating elements, respectively, and which are separately controlled and powered through a dash-mounted occupant switch. The occupant switch is connected to the vehicle's electrical system, which includes a source of direct current (e.g., the vehicle battery), and allows each of the respective heating elements to be individually actuated and the amount of current directed therethrough to be individually adjusted with a potentiometer. The occupant switch thus allows a passenger to select desired temperature settings for the device's seat bottom portion and backrest portion heaters, each respective selection having an occupant switch output voltage of corresponding temperature selection value.

In the '841 Publication, power for the first and second heating elements is received from the occupant switch and is directed through first and second control units, respectively. Each control unit includes an operational amplifier and a unipolar or field effect transistor (FET), with the operational amplifier controlling the gate voltage of its respective FET based on the respective temperature selection value and a respective temperature measurement output signal received from a temperature sensor disposed in the seat bottom portion or backrest portion. Each temperature sensor is positioned at a predetermined distance from, and is in thermal communication with, its respective heating element for measuring its thermal output and generating a corresponding temperature measurement value. Thus, the thermal input to each temperature sensor is influenced by the amount of current being directed through its associated heating element, and provides the respective control unit with feedback (i.e., the temperature measurement value) that is compared with the temperature selection value received from the occupant switch. The comparison of temperature selection and measurement values by the operational amplifier is determinative of the amount of current to be allowed to pass through the FET and to its heating element.

In the '841 Publication, the occupant switch mounted in the dash is provided with sufficient electrical current to accommodate powering both the first and second heaters simultaneously. The conductor feeding power to the occupant switch from the vehicle's source of direct current must therefore be sized appropriately large. Moreover, each of the first and second heating elements has its own temperature sensor for providing feedback to its respective control unit. Powering and controlling each of the first and second heating elements therefore requires three conductors extending between the seat bottom portion or backrest portion and its associated first or second control unit. Each of the control units requires three conductors extending between it and the occupant switch. Those of ordinary skill in the art will also appreciate that distances between the switch and/or control unit(s) and/or its respective heating elements bear on the size, material, cost, and failure risk of conductors extending therebetween.

Allowing the individual heating elements of seat heating devices to operate simultaneously, as disclosed in the '841 Publication, can significantly tax the vehicle's electrical system. Further, the consequent size of conductors and the complexity of wiring harnesses for such devices can undesirably affect device cost and reliability. Moreover, the use of multiple feedback elements such as the above-mentioned plurality of temperature sensors can present multiple opportunities for system failure that can result in uncontrolled activation of a heating element, which can result in occupant discomfort or further system failures due to overheating, or require continuous control adjustment by the occupant.

In the past, addressing such risks of failure typically entailed providing the system with redundancies or large design factors of safety that further adversely affect costs and complexity, or which may noticeably compromise heater performance.

An opportunity exists, therefore, to improve upon existing devices for heating a vehicle seat by addressing such concerns.

SUMMARY OF THE INVENTION

The present invention improves upon existing devices for heating a vehicle seat, and addresses the above-mentioned shortcomings of prior such devices.

The present invention provides a device for heating a vehicle seat, including a first and a second temperature control unit (TCU). The first TCU includes a first power-input terminal for receiving power from a vehicle electrical power system, a first power-output terminal from which is provided electrical power received by the first power-input terminal and selectively transferred through the first TCU, and a logic part for comparing received temperature selection and temperature measurement values. The logic part has a temperature selection input terminal for receiving a temperature selection value, a first temperature measurement input terminal for receiving a first temperature measurement value, and first and second output terminals from each of which exclusively of the other an actuation signal output is alternatingly provided. The first TCU also includes a first and a second pulse generator. The first pulse generator has an input terminal connected to the first output terminal of the logic part for receiving the alternatingly provided actuation signal output of the logic part, and an output terminal from which is sent an electrical pulse output caused by the first pulse generator receiving the alternatingly provided actuation signal output of the logic part.

The second pulse generator has an input terminal connected to the second output terminal of the logic part for receiving the alternatingly provided actuation signal output of the logic part, and an output terminal from which is sent an electrical pulse output caused by the second pulse generator receiving the alternatingly provided actuation signal output of the logic part.

The first TCU also includes a first switch unit having a first control-input terminal coupled to the first pulse generator output terminal for receiving an intermittently applied signal voltage caused by the electrical pulse output of the first pulse generator, the first power-input terminal and the first power-output terminal in electrical communication through the first switch unit in response to the intermittent signal voltage application at the first control-input terminal.

A first heating element for heating one of a bottom portion and a backrest portion of the vehicle seat is coupled to the first power-output terminal of the first TCU, the first heating element having a thermal output induced by electrical power from the vehicle electrical power system transferred to it through the first switch unit.

The second TCU is separate from and coupled to the first TCU and includes a second power-input terminal for receiving power from the vehicle electrical power system, a second power-output terminal from which is provided electrical power received by the second power-input terminal and selectively transferred through the second TCU, and a second switch unit having a second control-input terminal coupled to the second pulse generator output terminal for receiving an intermittently applied signal voltage caused by the electrical pulse output of the second pulse generator, the second power-input terminal and the second power-output terminal in intermittent electrical communication through the second switch unit in response to the intermittent signal voltage application at the second control-input terminal.

A second heating element for heating the other of the bottom portion and the backrest portion of the vehicle seat is coupled to the second power-output terminal of the second TCU, the second heating element having a thermal output induced by electrical power being transferred through the second switch unit.

An occupant switch is coupled to the first TCU for providing a temperature selection value output to the logic part. The occupant switch has at least one temperature selection output terminal for providing a selected one of a plurality of different temperature selection values to the temperature selection input terminal of the logic part.

The device also includes a first temperature sensor for monitoring the thermal output of the first heating element, the first temperature sensor coupled to the logic part and having a thermal input influenced by the thermal output of the first heating element and a temperature measurement output terminal from which a first temperature measurement value output corresponding to the thermal input is provided to the first temperature measurement input terminal of the logic part.

The present invention also provides a device for heating the bottom portion and backrest portion of a vehicle seat that includes a first temperature control unit having a logic part for comparing a received temperature selection value and at least one received temperature measurement value. The logic part has temperature measurement and temperature selection input terminals at which temperature measurement and selection values are respectively received, and first and second output terminals from each of which is provided an actuation signal output caused by a predetermined result in the comparison between the received temperature measurement and selection values. The actuation signal output of the logic part is alternatingly provided by each of its first and second output terminals exclusively of the other. The first temperature control unit also includes a first pulse generator having an input terminal connected to the first output terminal of the logic part and an output terminal from which is sent an electrical pulse output, the electrical pulse output caused by the first pulse generator receiving the actuation signal output of the logic part, and a second pulse generator having an input terminal connected to the second output terminal of the logic part and an output terminal from which is sent an electrical pulse output, the electrical pulse output caused by the second pulse generator receiving the actuation signal output of the logic part. The first temperature control unit also includes a first switch unit for energizing a first heating element, the first switch unit having a first control-input terminal coupled to the first pulse generator output terminal and to which a signal voltage is intermittently applied, a first power-input terminal adapted for connection to a source of electric current, and a first power-output terminal. Electric current flow from the first power-input terminal to the first power-output terminal through the first switch unit is permitted when the signal voltage is provided to the first control-input terminal of the first switch unit and substantially prevented when the signal voltage is not provided to the first control-input terminal of the first switch unit.

The device also includes a second temperature control unit separate from the first temperature control unit and having a second switch unit for energizing a second heating element. The second switch unit has a second control-input terminal coupled to the second pulse generator output terminal and to which a signal voltage is intermittently applied, a second power-input terminal adapted for connection to the source of electric current, and a second power-output terminal. Electric current flow from the second power-input terminal to the second power-output terminal through the second switch unit is permitted when the signal voltage is provided to the second control-input terminal of the second switch unit and substantially prevented when the signal voltage is not provided to the second control-input terminal of the second switch unit.

The device also includes a first heating element coupled to the first temperature control unit, the first heating element and the first temperature control unit both adapted for being commonly disposed in one of the bottom portion and the backrest portion of the vehicle seat. The first heating element has an input terminal adapted for connection to the first power-output terminal of the first switch unit for receiving electric current provided to the first power-input terminal of the first switch unit through the first temperature control unit. The device further includes a second heating element coupled to the second temperature control unit, the second heating element and the second temperature control unit both adapted for being commonly disposed in the other of the bottom portion and backrest portion of the vehicle seat. The second heating element has an input terminal adapted for connection to the second power-output terminal of the second switch unit for receiving electric current provided to the second power-input terminal of the second switch unit through the second temperature control unit.

The device includes an occupant switch coupled to the first temperature control unit for providing a temperature selection value to the logic part, the occupant switch having a plurality of different selective temperature settings each defining a respective temperature selection value, and at least one temperature selection output terminal adapted for connection to the temperature selection input terminal of the logic part. A temperature sensor is adapted for being disposed in one of the bottom portion and backrest portion of the vehicle seat, and having an output terminal coupled to a said temperature measurement input terminal of the logic part for providing the temperature measurement value received by the logic part. The temperature sensor has a thermal input influenced by one of said first and second heating elements receiving electric current from the respective first or second temperature control unit, the temperature sensor having a respective temperature measurement value defined at least in part by the thermal input and receivable at the temperature measurement input terminal of the logic part.

The device also includes a control signal conductor extending between the first and second temperature control units and between one and the other of the bottom portion and backrest portion of the vehicle seat, and through which is transmitted at least one of the electrical pulse output sent from the second pulse generator, the signal voltage applied to the second control-input terminal, and the temperature measurement value defined at least in part by the thermal input to the temperature sensor.

The second TCU is separate from the first TCU and includes a second switch unit for energizing a second heating element, the second switch unit having a second control-input terminal coupled to the second pulse generator output terminal for receiving an intermittently applied signal voltage, a second power-input terminal adapted for connection to the source of electric current, and a second power-output terminal. Electric current flow from the second power-input terminal to the second power-output terminal through the second switch unit is permitted when the signal voltage is provided to the second control-input terminal of the second switch unit and substantially prevented when the signal voltage is not provided to the second control-input terminal of the second switch unit.

The first heating element is coupled to the first TCU, the first heating element and first TCU both adapted for being commonly disposed in one of the bottom portion and the backrest portion of the vehicle seat. The first heating element has an input terminal adapted for connection to the first power-output terminal of the first switch unit for receiving electric current provided to the first power-input terminal of the first switch unit and transferred through the first TCU. The second heating element is coupled to the second TCU, the second heating element and second TCU both adapted for being commonly disposed in the other of the bottom portion and backrest portion of the vehicle seat. The second heating element has an input terminal adapted for connection to the second power-output terminal of the second switch unit for receiving electric current provided to the second power-input terminal of the second switch unit and transferred through the second TCU.

An occupant switch is coupled to the first TCU for providing a temperature selection value output to the logic part. The occupant switch has a temperature selection value output terminal for connection to the temperature selection input terminal of the logic part, and a plurality of different selective temperature settings each defining a respective temperature selection value. The device also includes a first temperature sensor adapted for being disposed in the same one of the bottom portion and backrest portion of the vehicle seat as the first TCU, and is coupled to the logic part. The first temperature sensor has a thermal input influenced by the first heating element receiving electric current from the first TCU, a respective temperature measurement value defined at least in part by the thermal input, and an output terminal from which is sent a first temperature measurement value output receivable at a first temperature measurement input terminal of the logic part.

The device may also include a second temperature sensor for monitoring the thermal output of the second heating element. The second temperature sensor has a thermal input influenced by the second heating element when energized and a temperature measurement output terminal from which is sent a second temperature measurement value output corresponding to the thermal input. The second temperature measurement value may be utilized internally to the second TCU or, alternatively, communicated to the logic part, for controlling the electrical power transferred through the second TCU and provided to the second power-output terminal and the second heating element connected thereto.

Preferably, a single control signal conductor extends between the first and second TCUs, and the seat portions in which they are respectively disposed.

Thus, the present invention provides a device for heating a vehicle seat, the device including a first TCU and a separate second TCU, with each of the TCUs having a respective heating element coupled thereto. The first TCU includes a logic unit and first and second pulse generators that are alternatingly actuated by the actuation signal output of the logic unit.

The device may also include optional voltage doubler circuits for increasing the voltages of the electrical pulse outputs from the pulse generators. Each TCU includes a switch unit located between and coupled to the respective pulse generator and heating element for energizing the heating element in response to receiving a signal voltage caused by the electrical pulse output from the pulse generator.

The logic part compares the received temperature selection and s and provides an actuation signal output exclusively to either the first pulse generator or the second pulse generator, both of which are connected to the logic part, causing the respective pulse generator to provide an electrical pulse output. The frequency of the electrical pulse output corresponds to the temperature selection value.

If the device includes optional voltage doubler circuits, the first pulse generator is connected to a first voltage doubler circuit for the first heating element, and the second pulse generator is connected to a second voltage doubler circuit for the second heating element. The first pulse generator and the second pulse generator, and the first voltage doubler circuit, if included, are disposed in the first TCU. The second voltage doubler circuit, if included, may be disposed in either the first or the second TCU. Each voltage doubler circuit provides an intermittent signal voltage to the respective switch unit. Temperature sensors located in the seat bottom and backrest portions each have a thermal input influenced by the respective heating element. At least one of the temperature sensors has its temperature measurement value output communicated to the logic part for comparison with the temperature selection value received thereby. A single, low current control signal conductor carrying pulsed signals extends between the first and second TCUs, and the seat bottom and backrest portions in which they are respectively disposed.

Advantages provided by the present invention include a power limiting feature that protects against uncontrollable activation of the slave heater due to a cut or break in the single wire control signal conductor extending between the TCUs, reduction of the power consumption peak load on the vehicles electrical system, and improved device reliability.

BRIEF DESCRIPTION OF THE DRAWINGS

Other advantages of the present invention will be readily appreciated, as the same becomes better understood by reference to the following detailed description when considered in connection with the accompanying drawings, wherein.

DETAILED DESCRIPTION OF EXEMPLARY EMBODIMENTS

Figure 1:
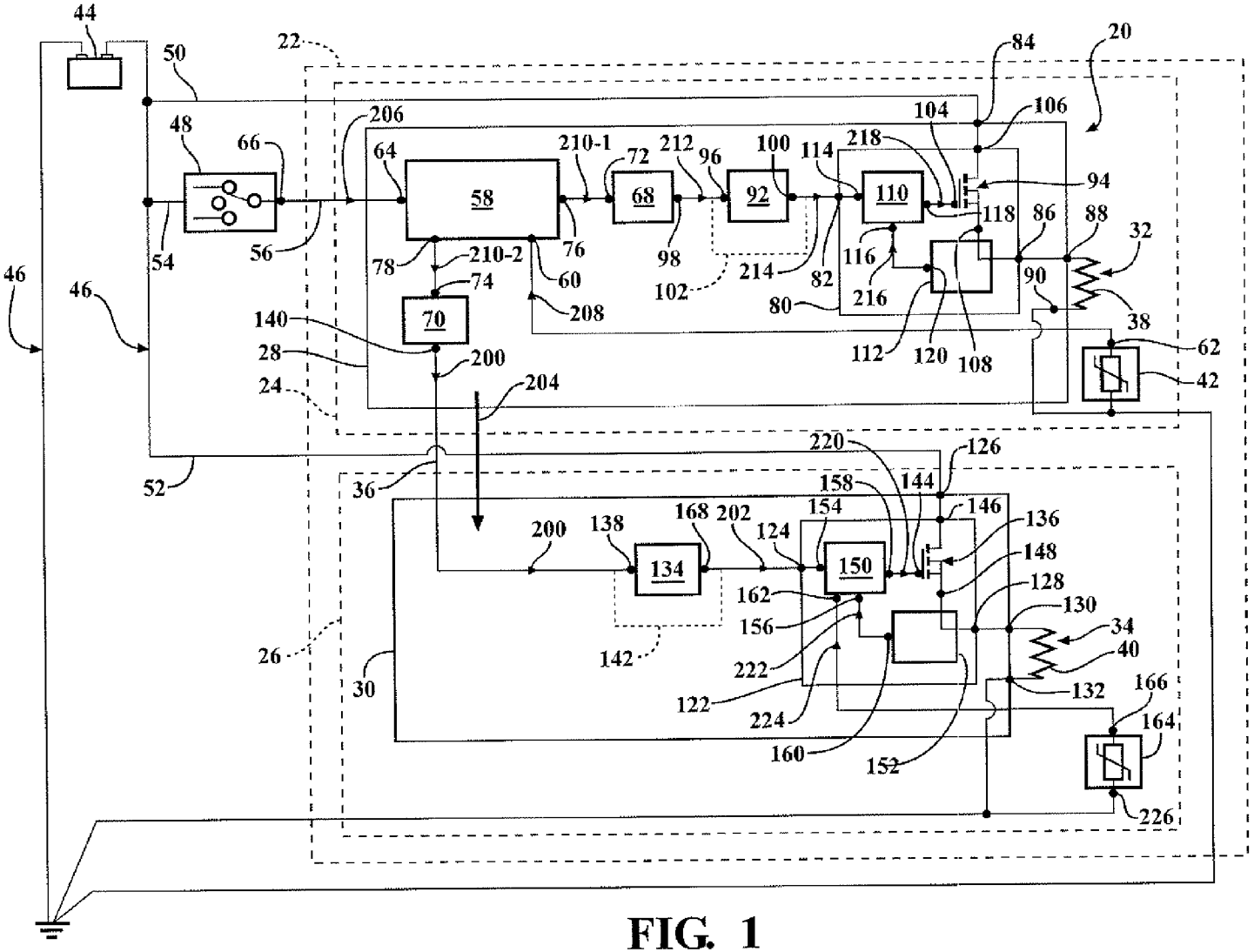
FIG. 1 is a schematic representation of a first embodiment device for heating a vehicle seat shown connected to a vehicle's electrical distribution system, the vehicle seat bottom portion and backrest portion represented in phantom lines.
Figure 2:
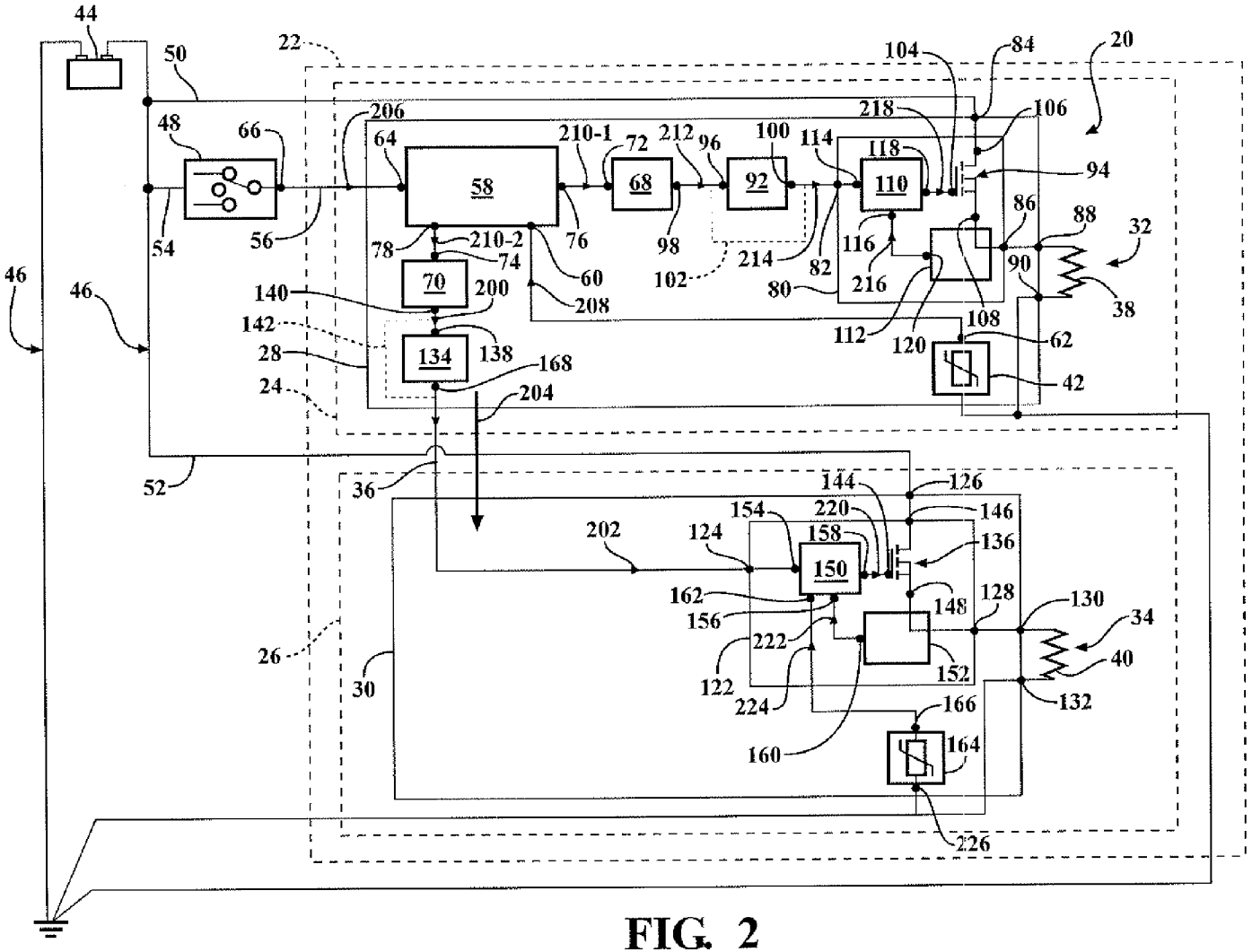
FIG. 2 is a schematic representation of a second embodiment device for heating a vehicle seat shown connected to a vehicle's electrical distribution system, the vehicle seat bottom portion and backrest portion represented in phantom lines.

Shown in the attached FIGS. 1 and 2 are first and second embodiments of device 20, also referred to herein as devices 20*a* and 20*b*, respectively, for heating a vehicle seat 22 having a bottom portion 24 and a backrest portion 26. Device 20 includes a first or master temperature control unit (TCU) 28 and a separate second or slave TCU 30. A first or master heating element 32 is coupled to the first TCU 28, and is positioned in the cushion of the vehicle seat bottom portion 24 of the vehicle seat 22. A second or slave heating element 34 is coupled to the second TCU 30, and is positioned in the cushion of the vehicle seat backrest portion 26. The first and second TCUs 28, 30 are separate and are preferably disposed in the seat bottom portion 24 and backrest portion 26, respectively, interconnected solely by a control signal conductor 36 through which a pulsed voltage signal 200 or 202 is transmitted. The control signal conductor 36 may include a single wire through which the pulsed signal 200 or 202 is conveyed between the first 28 and second 30 TCUs. In devices 20*a* and 20*b*, the flow of pulsed signals 200 or 202 through control signal conductor 36 is unidirectional, from first TCU 28 to second TCU 30, as indicated by arrow 204. Arrowheads indicate the flow directions of information communicated by the pulsed electrical signals in the various embodiments of device 20 shown in the Figures.

The first heating element 32 and the second heating element 34 are of known type, and each includes an electrical conductor 38, 40 having electrical resistance such that the passing of electrical current therethrough will cause the electrical conductor 38, 40 to generate heat, warming its respective seat portion. It is to be understood that although it may be preferable for the first TCU 28 and the first heating element 32 to be disposed in the vehicle seat bottom portion 24, and for the second TCU 30 and the second heating element 34 to be disposed in the vehicle seat backrest portion 26, their locations vis-à-vis the vehicle seat portions 24, 26 may be reversed.

A first temperature sensor 42 is positioned in the vehicle seat bottom portion 24 at a predetermined distance from, and in thermal communication with, the first heating element 32 for measuring a seat bottom portion temperature. The first temperature sensor 42 is of a known type in which is generated an output voltage signal corresponding to the sensed temperature of its environment. The thermal input to the first temperature sensor 42 is influenced by the first heating element 32 when energized, i.e., when provided with electrical current from the first TCU 28. The first temperature sensor 42 may be external to the first TCU 28 as shown in FIG. 1, or housed within or externally affixed to the first TCU 28 and thus comprising a part thereof, as shown in FIG. 2.

A source of direct current 44 (e.g., the vehicle battery) energizes the vehicle's electrical system 46 and is connected therethrough to the first TCU 28, the second TCU 30, and an occupant switch 48 through respective electrical conductors 50, 52, 54 arranged in a parallel circuit configuration. The occupant switch 48 is coupled to the first TCU 28 for allowing a seat occupant to select a temperature setting (e.g., OFF, LOW, or HIGH) for the seat's respective device 20, with each switch setting corresponding to a temperature selection value 206. The temperature selection value 206 is communicated as a corresponding, continual voltage signal (i.e., not a pulsed voltage signal), which may include a zero voltage signal in the case of an OFF switch setting, via a single wire conductor 56 to the first TCU 28. The occupant switch 48 may be installed on the vehicle seat, dash, or console, or any other location convenient for the seat occupant.

The first TCU 28 includes a logic part 58 for interfacing with the first temperature sensor 42 and the occupant switch 48; the logic part 58 receives as a continual voltage signal a first temperature measurement value 208 from the first temperature sensor 42 and the temperature selection value 206 from the occupant switch 48. A suitable example of a logic part 58 includes, but is not limited to, a microcontroller unit (MCU) that contains application software and well-known hardware resources to interface with pulse generator, temperature sensor, and occupant switch circuitry. The logic part 58 receives the first temperature measurement value 208 at a first temperature measurement input terminal 60 from the temperature measurement output terminal 62 of the first temperature sensor 42, and receives the temperature selection value 206 at its temperature selection input terminal 64 from the temperature selection output terminal 66 of the occupant switch 48 via the single wire conductor 56. As used herein, "terminal" refers to a structural part of a component of device 20 to or from which an electrical input or output is communicated, as through a conductor. The logic part 58 compares the received temperature selection 206 and measurement 208 values, and generates an actuation signal output 210 if it determines that the switch 48 is on and that a received first temperature measurement value 208 is comparatively less than a received temperature selection value 206, and will interrupt the actuation signal generation if it determines that the received temperature measurement value 208 satisfactorily corresponds to (e.g., meets or exceeds) the received temperature selection value 206.

A first or master pulse generator 68, and a second or slave pulse generator 70, are both located in the first TCU 28 and have input terminals 72, 74 respectively connected to the first and second output terminals 76, 78 of the logic part 58. The actuation signal output 210 of the logic part 58 is alternatingly directed exclusively to either the first 76 or the second 78 output terminal of the logic part 58, thereby causing the input terminal 72, 74 of one of the first pulse generator 68 and the second pulse generator 70 to exclusively receive the actuation signal output 210 from the logic part 58 at any given time. The pulse generators 68, 70 are of a type well-known in the art, each containing current amplifier and slope control circuitry to gain the actuation signal output 210 it receives from the logic part 58. The actuation signal output 210 sent from the first output terminal 76 is also referred to herein as the first actuation signal output 210-1, and the actuation signal output 210 sent from the second output terminal 78 is also referred to herein as the second actuation signal output 210-2.

In devices 20*a* and 20*b*, the actuation signal output 210 of the logic part 58 is preferably in the form of a series of electrical pulses each of uniform magnitude, the frequency of the pulses corresponding to the temperature selection value 206 received by the logic part 58 from the occupant switch 48. The durations of the periods over which the actuation signal output 210 is exclusively emitted from the first 76 and second 78 output terminals of the logic part 58, establish the heating "balance" between the seat bottom portion 24 and backrest portion 26, and may be a parameter defined in the application software contained in the MCU 58. This parameter is perhaps best determined through subjective evaluations performed during vehicle development testing. This parameter may also be correctively reprogrammed, if necessary, by vehicle service personnel in a manner well-known in the art, such as by software flashing, to fine-tune seat heating qualities to a particular occupant's preference.

A first or master switch unit 80 is located in the first TCU 28, and has a first control-input terminal 82, a first power-input terminal 84 coupled to the conductor 50 of the vehicle electrical system 46, and a first power-output terminal 86 coupled to the input terminal 88 of the electrically resistive conductor 38 that forms the first heating element 32. The output terminal 90 of the electrically resistive conductor 38 of the first heating element 32 is grounded.

An optional first or master voltage doubler circuit 92 may be provided in the first TCU 28 if necessary for the proper operation of a first FET 94 included in the first switch unit 80. The first voltage doubler circuit 92 has an input terminal 96 that is connected to the output terminal 98 of the first pulse generator 68, and is utilized for increasing to a higher level the magnitude of the voltage of the electrical pulse output 212 received from the first pulse generator 68. The first voltage doubler circuit or DC-DC converter 92 is also known by those of ordinary skill in the art as a DC-DC boost converter or step-up converter. Such converter devices are well-known to those of ordinary skill in the art, and generally include a set of capacitors and diodes used to raise voltage from a first level to a second, higher level as necessary to operate an FET, ensuring that the voltage applied to the FET gate terminal is above a threshold voltage level required to open the conductance channel between the FET source and drain terminals, thus placing the first FET 94 in its ON-state. The conductance channel in the first FET 94 is closed in the FET's OFF-state, which occurs when the voltage applied to the gate terminal 104 falls below the threshold voltage, preventing current from flowing through the first FET 94 between source and drain terminals 106, 108. Device 20 is protected from deleterious effects of a short circuit through the first FET 94 by a conveniently located fuse (not shown).

The optional first DC-DC converter 92 may be incorporated into the first TCU 28 as an integrated circuit or as a complete hybrid circuit component. In response to receiving the electrical pulse output 212 of the first pulse generator 68, the first voltage doubler circuit 92, if included, applies a comparably higher level signal voltage 214 to its output terminal 100 and the first control-input terminal 82 of the first switch unit 80 that is connected thereto. If the first voltage doubler circuit 92 is deemed unnecessary for proper FET operation and omitted, then the output terminal 98 of the first pulse generator 68 may be connected to the first control-input terminal 82 of the first switch unit 80, as indicated by the dashed line 102 bypassing the first DC-DC converter 92 in FIGS. 1 and 2, and the abovementioned electrical pulse output 212 and signal voltage 214 are the selfsame.

In the first switch unit 80, the first FET 94 controllably passes electrical current from the conductor 50, connected to the first power-input terminal 84, to the first heating element 32, connected to the first power-output terminal 86. The first FET 94 may, for example, be a power MOSFET having a "vertical" structure, and has a gate terminal 104, a source terminal 106 and a drain terminal 108. The source terminal 106 and drain terminal 108 of the first FET 94 are connected to or are the selfsame first power-input terminal 84 and first power-output terminal 86, respectively, of the first switch unit 80 and first TCU 28.

The first switch unit 80 optionally includes a first gate voltage controller 110 and a first current sensor 112. The first gate voltage controller 110 has a first input terminal 114 that is connected to or is the selfsame first control-input terminal 82 of the first switch unit 80, a second input terminal 116, and an output terminal 118 that is connected to the gate terminal 104 of the first FET 94.

First current sensor 112 is of a type well-known to those of ordinary skill in the art, and includes circuitry having a power resistor and a voltage sensor. If a large current indicative of an undesirably high rate of current increase goes through the power resistor the first current sensor 112 reacts and activates its output signal 216. The second input terminal 116 of the first gate voltage controller 110 is connected to the output terminal 120 of the first current sensor 112 and receives therefrom the output signal 216 indicative of the undesirably high rate of current increase. The first gate voltage controller 110 contains logic to activate and deactivate its gate voltage output signal 218 to the gate terminal 104 depending on the signal voltage 214 received at its first input terminal 114 and to reduce the duration of gate voltage output signals 218 provided to the gate terminal 104 if an output signal 216 from current sensor 112 has been received at the second input terminal 116.

The gate voltage output signal 218 applied to output terminal 118 of first gate voltage controller 110 and gate terminal 104 connected thereto is changed with a slow going rate so as to not generate radio disturbance, but may be rapidly turned off if a high current condition is detected by the circuitry of the first current sensor 112. In the event of the second input terminal 116 of the first gate voltage controller 110 receiving an output signal 216 from the first current sensor 112 indicative of an undesirable rate of current rise the duration of the pulsed gate voltage output signal 218 applied to the first FET 94 from output terminal 118 of the first gate voltage controller 110 is reduced, and the first FET 94 dwells longer in its OFF-state, in which no electrical current is permitted to pass therethrough from the source terminal 106 to the drain terminal 108.

In the absence of the first gate voltage controller 110 having received an undesirable current rate-indicating output signal 216 from the first current sensor 112, or if the optional first gate controller 110 and the first current sensor 112 have been altogether omitted from a normally operating device 20, a conductance channel is opened in the first FET 94 between its source and drain terminals 106, 108 in the FET's ON-state, which occurs when a gate voltage output signal 218 exceeding the FET gate threshold voltage is applied to the gate terminal 104, allowing current to flow from the source terminal 106, which is connected to the source of direct current 44, to the drain terminal 108 and the resistive conductor 38. The first TCU 28 thus energizes the first heating element 32 in response to the electrical pulse output 212 from the first pulse generator 68 that is disposed in the first TCU 28.

A second or slave switch unit 122 is located in the second TCU 30, and has a second control-input terminal 124, a second power-input terminal 126 coupled to the conductor 52 of the vehicle electrical system 46, and a second power-output terminal 128 coupled to the input terminal 130 of the electrically resistive conductor 40 that forms the second heating element 34. The output terminal 132 of the electrically resistive conductor 40 of the second heating element 34 is grounded.

An optional second or slave voltage doubler circuit 134 may be provided if necessary for the proper operation of a second FET 136 that is included in the second switch unit 122. In the second switch unit 122, the second FET 136 controllably passes electrical current from the conductor 52 connected to the second power-input terminal 126 to the second power-output terminal 128 and the second heating element 34 connected thereto. The second FET 136 may be substantially identical to the first FET 94, and has a gate terminal 144, a source terminal 146 and a drain terminal 148. The source terminal 146 and drain terminal 148 of the second FET 136 are connected to, or are the selfsame second power-input terminal 126 and second power-output terminal 128, respectively, of the second switch unit 122 and second TCU 30. The conductance channel in the second FET 136 is closed in the FET's OFF-state, which occurs when the gate voltage output signal 220 applied to the gate terminal 144 falls below the threshold voltage, preventing current from flowing through the second FET 136 between source and drain terminals 146, 148. Device 20 is protected from deleterious effects of a short circuit through the second FET 136 by a conveniently located fuse (not shown).

The second voltage doubler circuit 134, if included, has an input terminal 138 that is connected to the output terminal 140 of the second pulse generator 70, and is utilized for increasing to a higher level the magnitude of the voltage of the electrical pulse output 200 received from the second pulse generator 70. In devices 20*a* and 20*b*, the second voltage doubler circuit or DC-DC converter 134 may be substantially similar to the first voltage doubler circuit 92 and is also known by those of ordinary skill in the art as a DC-DC boost converter or step-up converter.

The optional second DC-DC converter 134 may be incorporated into the first TCU 28 as shown in FIG. 1, or into the second TCU 30 as shown in FIG. 2, as an integrated circuit or as a complete hybrid circuit component. In response to receiving the electrical pulse output 200 of the second pulse generator 70, the second voltage doubler circuit 134, if included, applies its comparably higher level signal voltage 202 to the second control-input terminal 124 of the second switch unit 122. If the second voltage doubler circuit 134 is deemed unnecessary for proper FET operation and omitted, then the output terminal 140 of the second pulse generator 70 may be connected to the second control-input terminal 124 of the second switch unit 122, as indicated by the dashed line 142 bypassing the second DC-DC converter 134 in FIGS. 1 and 2, and the abovementioned electrical pulse output 200 and signal voltage 202 are the selfsame. Regardless of the second voltage doubler circuit 134 being disposed in the first TCU 28 or the second TCU 30, the low-current-carrying control signal conductor 36 solely extends between the first and second TCUs 28 and 30, and thus between seat portions 24 and 26. The electrical pulse output 200 or the pulsed signal voltage 202 that is transmitted through control signal conductor 36, originates at the output terminal 140 of second pulse generator 70, or at the output terminal 168 of the second voltage double circuit 134 if present and disposed in first TCU 28.

The second switch unit 122 optionally includes a second gate voltage controller 150 and a second current sensor 152. In devices 20*a* and 20*b*, the second gate voltage controller 150 has a first input terminal 154 that is connected to or is the selfsame second control-input terminal 124 of the second switch unit 122, a second input terminal 156 that is connected to the second current sensor 152, and an output terminal 158 that is connected to the gate terminal 144 of the second FET 136.

In the first and second embodiments of device 20, the second current sensor 152 is of a type well-known to those of ordinary skill in the art, and may be substantially identical to the first current sensor 112. If a large current indicative of an undesirable rate of current increase goes through its power resistor the second current sensor 152 reacts and activates its output signal 222. The second input terminal 156 of the second gate voltage controller 150 is connected to the output terminal 160 of the second current sensor 152 and receives therefrom the output signal 222 indicative of an undesirably high rate of current increase. The second gate voltage controller 150 contains logic to activate and deactivate its gate voltage output signal 220 depending on the signal voltage 202 received at its first input terminal 154 and to reduce the duration of pulsed gate voltage output signals 220 provided to the gate terminal 144 if the output signal 222 from second current sensor 152 has been received at the second input terminal 156.

In the event of the second input terminal 156 of the second gate voltage controller 150 receiving an output signal 222 from the second current sensor 152 indicative of an undesirable rate of current rise, the duration of the gate voltage output signals 220 applied to the second FET 136 from output terminal 158 of the second gate voltage controller 150 is reduced, and the second FET 136 dwells longer in its OFF-state, in which no electrical current is permitted to pass therethrough from the source terminal 146 to the drain terminal 148.

As shown in FIGS. 1 and 2, the second gate voltage controller 150 of devices 20*a* and 20*b* may also include a third input terminal 162 to which a second temperature sensor 164 is connected. If provided, the second temperature sensor 164 is in thermal communication with the second heating element 34, and has an output terminal 166 connected to the third input terminal 162 of the second gate voltage controller 150.

In devices 20*a* and 20*b*, the second temperature sensor 164 may be substantially similar to the first temperature sensor 42 and is positioned at a predetermined distance from the second heating element 34. It has a thermal input influenced by the second heating element 34 when energized. In devices 20*a* and 20*b*, the second temperature sensor 164 generates as a continual voltage signal a second temperature measurement value 224 corresponding to the sensed temperature of the second heating element 34. At a predefined level, the second temperature measurement value 224 received at the third input terminal 162 of the second gate voltage controller 150 signals the second gate voltage controller 150 to interrupt generation of its gate voltage output signals 220, and thus the current passage through the second FET 136. This predefined level is perhaps best determined through subjective evaluations performed during vehicle development testing, and is also a parameter that may also be correctively reprogrammed, if necessary, by vehicle service personnel in a manner well-known in the art, such as by software flashing, to fine-tune seat heating qualities to a particular occupant's preference. The second temperature sensor 164 may be external to the second TCU 30 as shown in FIG. 1, or housed within or externally affixed to the second TCU 30 and thus comprising a part thereof, as shown in FIG. 2.

Configured as shown in FIG. 1 or 2, the second gate voltage controller 150 of devices 20*a* and 20*b* activates and deactivates its application of the gate voltage output signal 220 to the gate terminal 144 of the second FET 136 responsive to receiving the intermittent signal voltage 202 at the first input terminal 154. Second gate voltage controller 150 contains logic to shorten the duration of the gate voltage output signals 220 in response to receiving the appropriate output signal 222 from the second current sensor 152 at its second input terminal 156, and to discontinue providing gate voltage output signals 220 in response to receiving a second temperature measurement value 224 of sufficient magnitude from the second temperature sensor 164 at its third input terminal 162.

The gate voltage output signal 220 applied to output terminal 158 of the second gate voltage controller 150 and the gate terminal 144 of the second FET 136 is changed with a slow going rate so as to not generate radio disturbance, but may be rapidly turned off if a high current condition is detected by the circuitry of the second current sensor 152. Device 20 is protected from deleterious effects of a short circuit through the second FET 136 by a conveniently located fuse (not shown).

In the absence of the second gate voltage controller 150 having received an output signal 222 from the second current sensor 152 indicative of an undesirably high rate of current increase, or a second temperature measurement value 224 from the second temperature sensor 164 of a magnitude indicative of the thermal output of second heating element 34 exceeding a defined level, or, if the optional second gate controller 150, the second current sensor 152 and the second temperature sensor 164 have been altogether omitted from a normally operating device 20*a* or 20*b*, a conductance channel is opened in the second FET 136 between its source and drain terminals 146, 148 in the FET's ON-state, during which the second TCU 30 energizes the second heating element 34 in response to the electrical pulse output 200 from the second pulse generator 70.

If the second voltage doubler circuit 134 is utilized in device 20 and is disposed within the second TCU 30, as in the first embodiment device 20*a* shown in FIG. 1, the control signal conductor 36 interconnects the output terminal 140 of the second pulse generator 70 and the input terminal 138 of the second voltage doubler circuit 134, and solely extends between the seat bottom portion 24 and the seat backrest portion 26. Alternatively, if the second voltage doubler circuit 134 is utilized and is disposed within the first TCU 28, as in the second embodiment device 20*b* shown in FIG. 2, the control signal conductor 36 interconnects the output terminal 168 of the second voltage doubler circuit 134 and the second control-input terminal 124 of the second switch unit 122, and likewise solely extends between the seat bottom portion 24 and the seat backrest portion 26. If, however, the optional second voltage doubler circuit 134 is deemed unnecessary for proper operation of the second FET 136 and omitted from device 20*a* or 20*b*, as indicated by the bypassing dashed line 142 in FIGS. 1 and 2, the control signal conductor 36 interconnects the output terminal 140 of the second pulse generator 70 and the second control-input terminal 124 of the second switch unit 122, and also likewise solely extends between the seat bottom portion 24 and the seat backrest portion 26.

Figure 3:
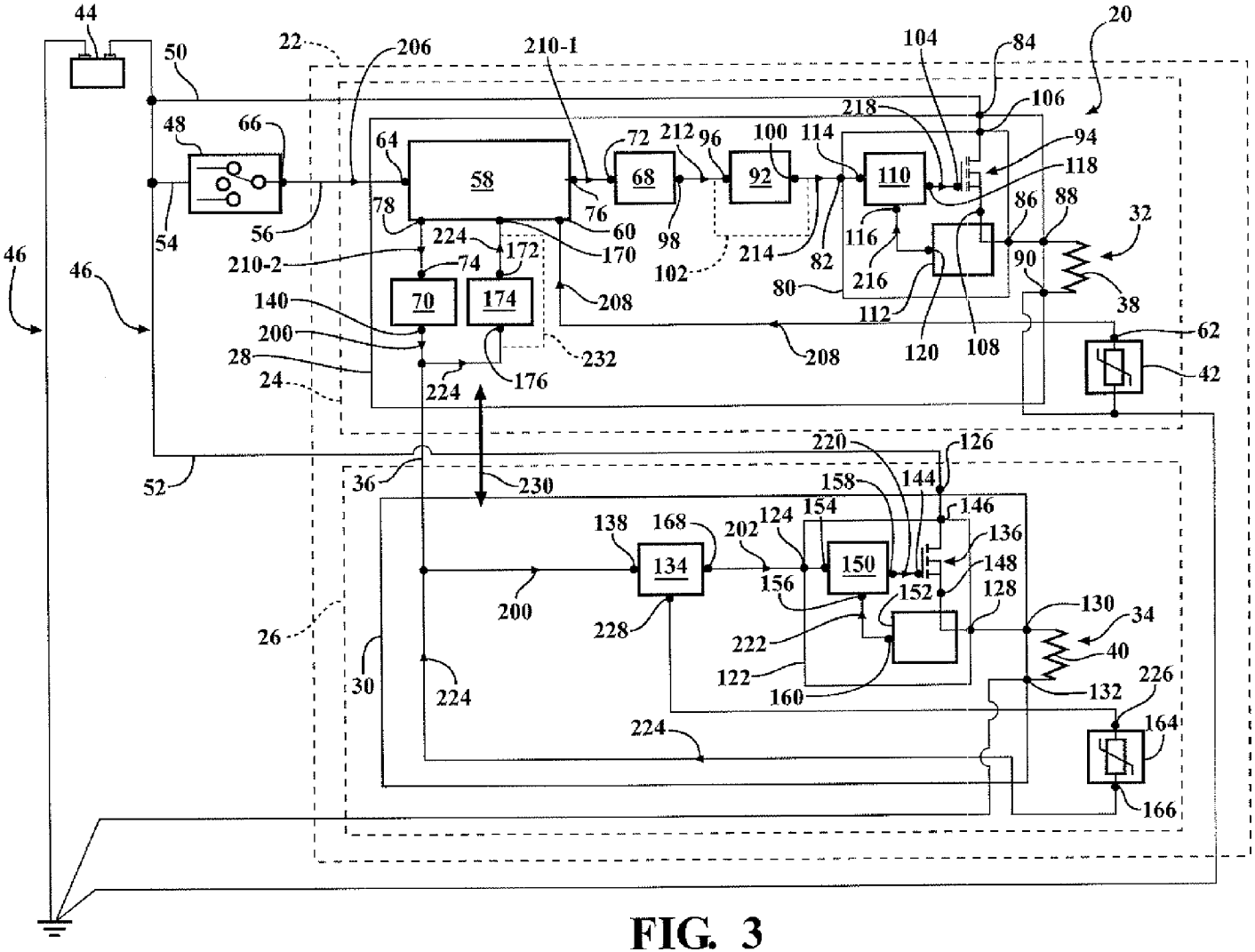
FIG. 3 is a schematic representation of a third embodiment device for heating a vehicle seat shown connected to a vehicle's electrical distribution system, the vehicle seat bottom portion and backrest portion represented in phantom lines.
Figure 4:
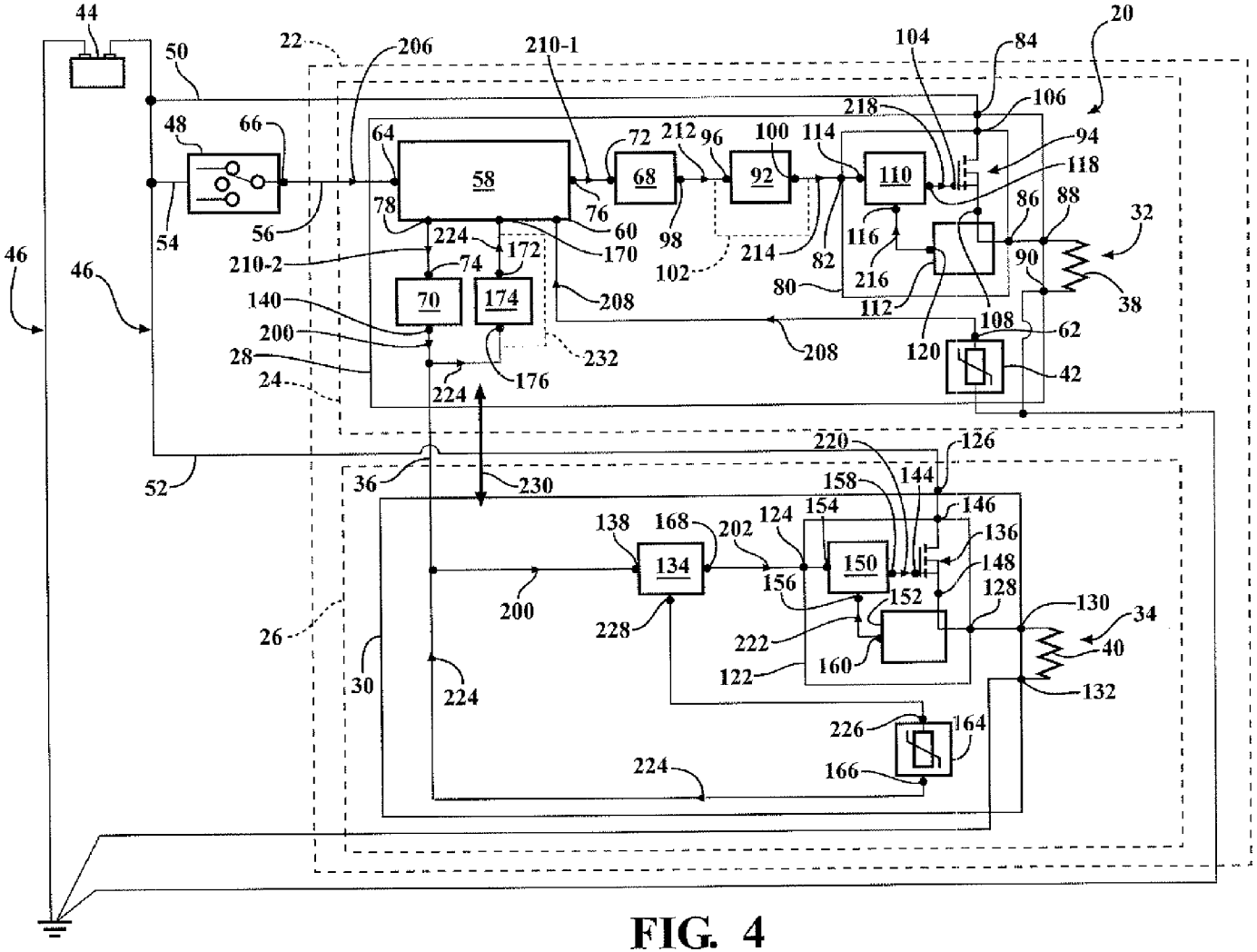
FIG. 4 is a schematic representation of a fourth embodiment device for heating a vehicle seat shown connected to a vehicle's electrical distribution system, the vehicle seat bottom portion and backrest portion represented in phantom lines.

Shown in the FIGS. 3 and 4 are third and fourth embodiments of device 20, also referred to herein as devices 20*c* and 20*d*, respectively, for heating a vehicle seat 22 having a bottom portion 24 and a backrest portion 26. Except as herein described, third and fourth embodiment devices 20*c* and 20*d* respectively correspond structurally and functionally to first and second embodiment devices 20*a* and 20*b*.

As in first and second embodiment devices 20*a* and 20*b*, each of third and fourth embodiment devices 20*c* and 20*d* includes a first or master temperature control unit (TCU) 28 and a separate second or slave TCU 30. As shown in FIGS. 3 and 4, first or master heating element 32 is coupled to the first TCU 28, and is positioned in the cushion of the vehicle seat bottom portion 24 of the vehicle seat 22. A second or slave heating element 34 is coupled to the second TCU 30 and is positioned in the cushion of the vehicle seat backrest portion 26.

As in devices 20*a* and 20*b*, in devices 20*c* and 20*d* the first and second TCUs 28, 30 are interconnected solely by a control signal conductor 36 through which a pulsed voltage signal is transmitted. The control signal conductor 36 may include a single wire through which a pulsed, low-current signal is conveyed between the first TCU 28 and the second TCU 30. Control signal conductor 36 may be branched within each TCU 28, 30 but is preferably formed of a single conductor wire between the TCUs, as shown.

In devices 20*c* and 20*d*, however, the pulsed signal communication transmitted through the single control signal conductor 36 between the first 28 and second 30 TCUs is multiplexed. The type of multiplexing employed in devices 20*c* and 20*d* may be either frequency-division multiplexing or time-division multiplexing.

If, in the exemplary third and fourth embodiments of device 20, frequency-division multiplexing is employed, logic part 58 is configured to have second temperature measurement input terminal 170 connected to the output terminal 172 of a temperature signal receiver 174 disposed within first TCU 28. The receiver 174 is tuned to receive, via a branch of control signal conductor 36 within the first TCU 28, the frequency at which an encoded signal emitted from output terminal 166 of the second temperature sensor 164 is transmitted.

As in devices 20*a* and 20*b*, in devices 20*c* and 20*d* the second temperature sensor 164 is positioned at a predetermined distance from the second heating element 34, has a thermal input influenced by the second heating element 34 when energized, and generates a second temperature measurement value 224 corresponding to the sensed temperature of the second heating element 34. In devices 20*c* and 20*d*, however, the second temperature sensor 164 also includes an encoder that generates a pulsed signal transmitted at the frequency to which temperature receiver 174 is tuned. This pulsed signal corresponds to, or is, the second temperature measurement value 224, the magnitude of which is influenced by the thermal input to second temperature sensor 164. Within second TCU 30, a branch of control signal conductor 36 is connected to output terminal 166 of the second temperature sensor 164, and the encoded second temperature measurement value 224 of second temperature sensor 164 emitted from its output terminal 166 is transmitted via control signal conductor 36 to the first TCU 28 and to the input terminal 176 of the temperature receiver 174. The temperature receiver 174 reads the encoded second temperature measurement value 224 and provides it to output terminal 172, which is connected to the second temperature measurement input terminal 170 of the logic part 58.

In third and fourth embodiment devices 20*c* and 20*d*, the logic part 58 compares the received first 208 and second 224 temperature measurement values and the temperature selection value 206, and generates an actuation signal output 210 that is alternatingly provided to either its first 76 and second 78 output terminal if it determines that the switch 48 is on and the received first 208 and second 224 temperature measurement values, individually or together in a predetermined relationship with each other, are comparatively less than the received temperature selection value 206. The logic part 58 will interrupt providing the actuation signal output 210 to both or, alternatively, if logic part 58 is so configured, to only a respective one of its first 76 and second 78 output terminals if the logic part 58 determines that the received first 208 and second 224 temperature measurement value(s) satisfactorily correspond(s) to (e.g., meet(s) or exceed(s)) the received temperature selection value 206. Thus, certain versions of devices 20*c* and 20*d* will, like devices 20*a* and 20*b*, discontinue providing actuation signal output 210 in response to the received temperature selection and measurement values satisfactorily corresponding; in certain other version of devices 20*c* and 20*d*, logic part 58 may instead be configured to continue providing one of actuation signal outputs 210-1 and 210-2 to its respective output terminal 76 or 78 while discontinuing providing the other one of actuation signal outputs 210-1 and 210-2 to its respective output terminal 76 or 78.

As in devices 20*a* and 20*b*, in devices 20*c* and 20*d* the input terminal 72 of the first pulse generator 68 is connected to the first output terminal 76 of the logic part 58 and intermittently receives actuation signal output 210-1, in response to which electrical pulse output 212 is generated thereby. The first switch unit 80 of the first TCU 28 is structurally and functionally as described above. Its first control-input terminal 82 is coupled (directly, or indirectly through first voltage doubler circuit 92) to the output terminal 98 of the first pulse generator 68 from which is sent an electrical pulse output 212. The first switch unit 80 is activated, and the first heating element 32 is energized, in response to a signal voltage 214 being received at first control-input terminal 82 in response to the actuation signal output 210-1 being provided to the first output terminal 76 of the logic part 58 and the electrical pulse output 212 caused thereby.

In third and fourth embodiment devices 20*c* and 20*d*, the second temperature sensor 164 has an input terminal 226 at which it continuously receives power from, for example, a second output terminal 228 of second voltage doubler circuit 134 which is disposed within the second TCU 30. In devices 20*c* and 20*d*, the second voltage doubler circuit 134 includes a receiver tuned to the frequency of the electrical pulse output 200 generated by the second pulse generator 70, which is disposed in the first TCU 28. The second voltage doubler circuit 134 of devices 20*c* and 20*d* receives at its input terminal 138 the electrical pulse output 200 emitted from the output terminal 140 of second pulse generator 70, which is transmitted from the first 28 to the second 30 TCU via control signal conductor 36. The frequency at which the electrical pulse output 200 emitted from the second pulse generator 70 is transmitted differs from that at which the encoded second temperature measurement value 224 emitted from the second temperature sensor 164 is transmitted to receiver 174. The second voltage doubler circuit 134 of devices 20*c* and 20*d* may otherwise be structurally and functionally as described above with regard to first and second embodiment devices 20*a* and 20*b*. As also described above, in devices 20*c* and 20*d*, the voltage increasing capabilities of the second voltage doubler circuit 134 may be omitted if unnecessary for proper functioning of the second FET 136, leaving it to function only as a receiver tuned for receiving the electrical pulse output 200 sent from second pulse generator 70, and as a power supply for the encoder of second temperature sensor 164.

Thus, in third and fourth embodiment devices 20*c* and 20*d*, the flow of the electrical pulse output 200 is from the first TCU 28 to the second TCU 30, and the flow of the pulsed, encoded second temperature measurement value output 224 is from the second TCU 30 to the first TCU 28. In other words, the multiplexed flows of the electrical pulse output 200 and the second temperature measurement value output 224 are in opposite directions through control signal conductor 36 and between the first 28 and second 30 TCUs, as indicated by double-headed arrow 230.

Thus, in devices 20*c* and 20*d*, the multiplexed communication through control signal conductor 36 and between the first 28 and second 30 TCUs may be of the frequency-division type as described above. Alternatively, devices 20*c* and 20*d* may instead be configured to employ time-division multiplexing for transmitting oppositely-directed pulsed voltage signals through the control signal conductor 36, such as the electrical pulse output 200 from the second pulse generator 70 and the pulsed second temperature measurement value output 224 from the second temperature sensor/encoder 164. So configured, the transmissions of the electrical pulse output 200 to second voltage doubler circuit 134, and the pulsed second temperature measurement value output 224 to the logic part 58 are temporally coordinated to occur at mutually exclusive times, in a manner well-know to those of ordinary skill in the art. If time-division multiplexing is employed in devices 20*c* and 20*d*, the second voltage doubler circuit 134 or receiver 174 need not be tuned for receiving pulsed voltage signals transmitted at a particular frequencies. Receiver 174 may be omitted altogether, as indicated by the bypassing dashed line 232 in FIGS. 3 and 4, and the pulsed second temperature measurement value 224 provided directly to second input terminal 170 of logic part 58.

Thus, in each of the shown embodiments 20*a*, 20*b*, 20*c* and 20*d* of device 20, only a single, low-current control signal conductor (i.e., control signal conductor 36) need extend between the first and second TCUs 28, 30 and their respective seat portions 24, 26; no high-current power transmission conductors need pass between the TCUs 28, 30 or the seat portions 24, 26. This provides the advantage of minimizing the risk of an open circuit due to wire cutting or breaking between the seat bottom portion 24 and seat backrest portion 26. Packaging at least the second pulse generator 70 and perhaps also the second voltage doubler circuit 134 in the first TCU 28, rather than in the second TCU 30, can also provide an additional measure of safety, for a cut or break in the single wire control signal conductor 36 that extends between the first 28 and second 30 TCUs, and the seat portions 24 and 26, will only result in the loss of heating function in backrest portion 26, and not cause the second TCU 30 to uncontrollably activate the second heating element 34.

Further, as noted above, device 20 facilitates only one of the first and second FETs 94, 136 being active at a time, their activations being mutually exclusive of each other. This provides two advantages: First, it limits the total heater power consumption of the device 20. Second, it limits the power conducted through the vehicle's electrical power distribution system 46 and its conductors 50, 52, thereby reducing the risk of their becoming overloaded and overheated.

Moreover, because the first or master temperature TCU 28 contains most of the functionality of device 20, the second or slave TCU 30 need contain only the essential functionality to control the power of its respective second heating element 34. The advantage of having the second TCU 30 packaged in the same portion of seat 22 as its respective heating element 34 (e.g., in its backrest portion 26) is that it presents less risk of short circuits that might cause overheating of its heating element conductor 40, and other failure modes.

In addition to the above-described advantages devices 20*a*, 20*b*, 20*c*, and 20*d* provide vis-à-vis prior seat heating devices, multiplexing the pulsed voltage signal transmissions between the first 28 and second 30 TCUs provides further benefits, whether this is done by frequency-division or time-division multiplexing. The multiplexing of the oppositely directed transmissions of the electrical pulse output 200 and the second temperature measurement value output 224 through the single control signal conductor 36 extending between the first 28 and second 30 TCUs, as in devices 20*c* and 20*d*, affords the opportunity to commonize the first and second gate voltage controllers 110 and 150, and facilitate greater and more refined control over the first 32 and second 34 heating elements individually, facilitating greater seat occupant comfort.

While the invention is susceptible to various modifications and alternative forms, specific embodiments thereof are shown by way of example in the drawings and detailed description. It should be understood, however, that the drawings and detailed description thereof are not intended to limit the invention to the particular form(s) disclosed, but on the contrary, the intention is to cover all modifications, equivalents and alternatives falling within the spirit and scope of the present invention as defined by the appended claims.

What is claimed is:

1. A device (20) for heating a vehicle seat (22), comprising:

a first temperature control unit (28) including:

a logic part (58) configured to receive a temperature selection value (206) and a temperature measurement value (208, 224) and compare the received temperature selection value (206) and temperature measurement (208, 224) value, with the logic part (58) including first (76) and second (78) output terminals from each of which exclusively of the other an actuation signal output (210) is alternatingly provided;

a first pulse generator (68) connected to the first output terminal (76) of the logic part (58) and configured to receive the alternatingly provided actuation signal output (210-1) of the logic part (58) and provide an electrical pulse output (212);

a second pulse generator (70) connected to the second output terminal (78) of the logic part (58) and configured to receive the alternatingly provided actuation signal output (210-2) of the logic part (58) and provide an electrical pulse output (200); and a first switch unit (80) coupled to the first pulse generator (68) for receiving the electrical pulse output (212) of the first pulse generator (68) and configured to be placed in an ON-state in response to receiving the electrical pulse output (212) of the first pulse generator (68);

a first heating element (32) coupled to the first switch unit (80) and configured to heat one of a bottom portion (24) and a backrest portion (26) of the vehicle seat (22) when the first switch unit (80) is placed in the ON-state;

a second temperature control unit (30) separate from the first temperature control unit (28) and including:

a second switch unit (122) coupled to the second pulse generator (70) for receiving the electrical pulse output (200) of the second pulse generator (70) and configured to be placed in an ON-state in response to receiving the electrical pulse output (200) of the second pulse generator (70); and a second heating element (34) coupled to the second switch unit (122) and configured to heat the other one of the bottom portion (24) and the backrest portion (26) of the vehicle seat (22) when the second switch unit (122) is placed in the ON-state;

wherein the first (28) and second (30) temperature control units are coupled to one another solely by a single control signal conductor (36) through which pulsed signals are transmitted between the first (28) and second (30) temperature control units.

2. The device of claim 1, wherein the first (28) and second (30) temperature control units are each connected directly to a vehicle electrical power system (46) such that the first (28) and second (30) temperature control units receive power from the vehicle electrical power system (46) independently of one another for heating the first (32) and second (34) heating elements.

3. The device of claim 1, wherein the first temperature control unit (28) includes a first voltage doubler circuit (92) connected between the first pulse generator (68) and the first switch unit (80) and wherein the second temperature control unit (30) includes a second voltage doubler circuit (134) connected between the second pulse generator (70) and the second switch unit (122).

4. The device of claim 3, wherein the control signal conductor (36) is connected between the second pulse generator (70) in the first temperature control unit (28) and the second voltage doubler circuit (134) in the second temperature control unit (30).

5. The device of claim 3, wherein the first switch unit (80) includes a first FET (94) having a source terminal (106) for receiving power from the vehicle electrical power system (46), and wherein the second switch unit (122) includes a second FET (136) having a source terminal (146) for receiving power from the vehicle electrical power system (46) independent of the first FET (94).

6. The device of claim 5, wherein the first switch unit (80) includes a first gate voltage controller (110) for receiving signals from the first voltage doubler circuit (92) and controlling the first FET (94) and wherein the second switch unit (122) includes a second gate voltage controller (150) for receiving the signals from the second gate voltage controller (150) and controlling the second FET (136).

7. The device of claim 6, wherein the first switch unit (80) includes a first current sensor (112) coupled to the first FET (94) for sensing current provided to the first heating element (32) from the first FET (94) and coupled to the first gate voltage controller (110) for providing the first gate controller (110) with a current measurement output signal (216).

8. The device of claim 7, wherein the second switch unit (122) includes a second current sensor (152) coupled to the second FET (136) for sensing current provided to the second heating element (34) from the second FET (136) and coupled to the second gate voltage controller (150) for providing the second gate controller (150) with a current measurement output signal (222).

9. The device of claim 1, wherein transmission of pulsed signals through the control signal conductor (36) between the first (28) and second (30) temperature control units is bidirectional (230).

10. The device of claim 9, wherein bidirectional transmission of pulsed signals through the control signal conductor (36) includes the electrical pulse output (200) sent from the first temperature control unit (28) to the second temperature control unit (30), and a second temperature measurement value output (224) sent from the second temperature control unit (30) to the first temperature control unit (28).

11. The device of claim 10, wherein the electrical pulse output (200) and the second temperature measurement value output (224) transmitted through the control signal conductor (36) are multiplexed signals.

12. The device of claim 11, wherein the pulsed signals transmitted through the control signal conductor (36) are multiplexed using at least one of frequency-division type multiplexing and time-division type multiplexing.

13. The device of claim 1, wherein the actuation signal output (210) of the logic part (58) includes electrical pulses and with a frequency of the electrical pulses of the actuation signal output (210) being defined at least in part by the temperature selection value (206) received by the logic part (58).

14. The device of claim 1, wherein the first temperature control unit (28) is disposed within one of the bottom portion (24) and backrest portion (26) and wherein the second temperature control unit (30) is disposed within the other one of the bottom portion (24) and backrest portion (26).

15. The device of claim 1, wherein the first temperature control unit (28) includes a first voltage doubler circuit (92) connected between the first pulse generator (68) and the first switch unit (80), and a second voltage doubler circuit (134) connected to the second pulse generator (70), wherein the second voltage doubler circuit (134) is connected to the second switch unit (122) in the second temperature control unit (30).

16. The device of claim 15, wherein the control signal conductor (36) is connected between the second voltage doubler circuit (134) in the first temperature control unit (30) and the second switch unit (122) in the second temperature control unit (30).

* * * * *